United States Patent [19]

Camardella et al.

[11] Patent Number: 4,951,889

[45] Date of Patent: Aug. 28, 1990

[54] PROGRAMMABLE PERFECT LAYER WINDING SYSTEM

[75] Inventors: Marco Camardella, Lutherville; William D. Staigerwald, Bel Air, both of Md.

[73] Assignee: EPM Corporation, Baltimore, Md.

[21] Appl. No.: 364,308

[22] Filed: Jun. 12, 1989

[51] Int. Cl.[5] ..... B65H 54/20; B65H 54/12

[52] U.S. Cl. ..... 242/25 R; 242/7.07; 242/7.11; 242/7.14; 242/35.5 R; 242/158 R

[58] Field of Search ..... 242/25 R, 35.5 R, 158 R, 242/158 B, 158 F, 158.1, 158.2, 158.3, 158.4 R, 158.4 A, 158.5, 7.06, 7.07, 7.11, 7.14, 7.15, 7.16; 29/605

[56] References Cited

U.S. PATENT DOCUMENTS

| | | |
|---|---|---|
| 2,988,292 | 6/1961 | Bliss . |
| 3,470,721 | 10/1969 | Scheublein, Jr. et al. . |
| 3,610,006 | 10/1971 | Scheublein, Jr. et al. . |
| 3,876,166 | 4/1975 | Kadokura et al. . |
| 3,902,701 | 9/1975 | Orme . |
| 4,232,838 | 11/1980 | Bravin . |
| 4,244,539 | 1/1981 | Taneda et al. . |
| 4,456,199 | 6/1984 | Seibert . |
| 4,485,978 | 12/1984 | O'Connor . |
| 4,570,875 | 2/1986 | Buluschek . |
| 4,655,410 | 4/1987 | Ruffin et al. . |
| 4,725,010 | 2/1988 | Lothamer . |
| 4,738,406 | 4/1988 | Lothamer . |
| 4,741,500 | 5/1988 | Lavanchy . |
| 4,746,075 | 5/1988 | Hoxit . |

*Primary Examiner*—Stanley N. Gilreath

*Attorney, Agent, or Firm*—Oblon, Spivak, McClelland, Maier & Neustadt

[57] ABSTRACT

In a system for the simultaneous perfect winding of a plurality of wires, during steady state winding the load angles of each of the wire guide tubes is periodically sampled and the spindle speeds are individually adjusted so as to maintain the load angle at a predetermined value. During non-steady state winding at the end of each layer, the spindle speed is maintained constant and the traverse speed is increased so as to reduce the load angle to zero, after which the traverse direction is reversed. Two pistons in the tailstock reinforce the bobbin in both the radial and axial directions.

17 Claims, 11 Drawing Sheets

PROGRAMMABLE PERFECT LAYER WINDING SYSTEM

BACKGROUND OF THE INVENTION

1. Field of the Invention

The present invention is directed to an apparatus for winding filaments. More particularly, the present invention is directed to the perfect layer winding of coils of metal wire on bobbins.

2. Description of the Background Art

Machines for winding coils of filaments such as wires on bobbins are well known. Typically, these involve a rotating spindle upon which a bobbin is mounted. The end of a wire filament is fixed to the bobbin and wound thereupon during rotation of the spindle. The formation of discrete layers of perfectly wound wire requires that there be provided some sort of traverse mechanism for guiding the position of the wire along the axis of rotation of the bobbin during winding.

A common problem is that of precise coordination between the motion of the traverse mechanism and the axial point of winding on the bobbin. The axial position of the traverse mechanism should be slightly retarded with respect to the point of winding of the wire, in the winding direction, in order to assure that the turns of wire being wound on the bobbin are always preloaded against each other. This retardation of the position of the traverse produces an angle, called a "load angle", of the wire relative to the perpendicular to the rotational axis of the bobbin and spindle. In order to assure perfect winding, the load angle must be large enough that the turns are always preloaded against each other, but must be small enough to avoid crossovers of the turns onto the previously wound turns. The load angle may also be called the "wire guide angle."

Theoretically, if one knows the nominal diameter of the wire being wound and the rotational speed of the spindle, the advance speed of the traverse can be calculated to maintain a desired load angle Ad. However, in practice, variations in the wire diameter and bobbin length can cause the load angle to vary sufficiently that adjacent turns of the wound wire may have spaces between them, or there may be crossovers. Some sort of feedback system is therefore desirable for maintaining the load angle at the desired value "Ad".

Numerous feedback systems have been proposed. Typically, they involve adjusting the speed of the traverse mechanism so as to correspond to a desired speed providing a predetermined load angle. However, this made it impossible to wind more than one spool at a time since the speed of the traverse mechanism could not then conform to that necessary for plural, simultaneously wound bobbins.

U.S. Pat. No. 4,741,500 to Lavanchy discloses a process for winding cable in which a load angle controls a motor so as to maintain a correct winding position for the cable being wound. The motor could drive either the guide or the spool, however there is no disclosure of using the load angle of several cables guided by a single traverse mechanism or for separately adjusting the rotational speed of more than one spool.

SUMMARY OF THE INVENTION

It is an object of the present invention to provide a system for simultaneously perfectly winding a plurality of filaments or wires.

It is a further object of the invention to provide a system in which a single traverse mechanism can be used while maintaining a predetermined load angle for the wound filaments.

It is yet a further object of the invention to provide perfect winding of more than one layer for simultaneously wound filaments.

It is a further object of the invention to provide a rotating spindle and tailstock assembly for winding a filament in which the wound filament is supported both radially and axially by the tailstock.

The above, and other, objects are accomplished according to the present invention by a system for simultaneously winding elongated filaments in at least one layer of turns on rotating spindles in which there are provided means for supporting a plural number of the rotational spindles upon which spools may be mounted, variable speed motors for separately driving each of the spindles, a traverse movable along a traversing path substantially parallel to the axes of the spindles, a number of filament guides mounted on the traverse for guiding filaments to be wound on the spindles, means for separately detecting a position of each of the guides relative to the spindles along the traversing path, and control means responsive to the detecting means for independently controlling the rotational speed of each of the variable speed motors so that the filaments are wound in a desired pattern.

The detecting means comprise a number of filament guide tubes corresponding to the plural number of spindles, each of the filament guide tubes being pivotally mounted to the traverse about a pivot axis which is substantially transverse to a plane containing the traversing path and a corresponding one of the spindle axes. The detecting means further comprise means for sensing an angle of deviation of a pivot angle of the filament guide tubes from a plane containing the pivot axis and extending perpendicular to the spindle axis. The sensing means is preferably a digital encoder.

The control means comprise means for independently controlling the rotational speed of each of the variable speed motors such that the angle of deviation for each of the wire guide tubes (detected load angle Ac) substantially equals a desired load angle.

According to another feature of the invention, the control means includes means for progressively reducing the angle of deviation substantially to zero when the filament being wound approaches and is adjacent an end of one of the layers of turns, and for progressively increasing the angle of deviation from substantially zero to a negative value of the load angle when the filament being wound departs from and is adjacent to an end of one of the layers of turns. The need for the angle reversal is due to the reversal of the direction of movement of the traverse after the filament being wound reaches the end of one of the layers.

According to a further feature of the invention, a rotating spindle and tailstock assembly for winding a filament includes a spindle rotatable about a longitudinal axis thereof, the spindle having an axial bore extending from one end and tapering so as to have a progressively reduced diameter with increased distance from the one end, a first supporting flange formed on the spindle adjacent the one end, a cylinder movable coaxially with the bore, a first piston fitted in the cylinder and having a head extending from the cylinder and further including a second supporting flange positionable at an end of the spindle by movement of the cylinder toward the spindle, a second piston fitted in the first piston and having a head extending from the first piston, said head having a taper corresponding to the taper of the bore and being matingly fittable in the bore by movement of the cylinder toward the spindle, and fluid means in the cylinder for advancing the first and second pistons in a direction further towards the spindle. A filament wound on the spindle between the first and second flanges is thus axially rigidly supported by the flanges and radially supported by the head of the second piston.

Conceivably, the system of the invention could also be used with a fly winder.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
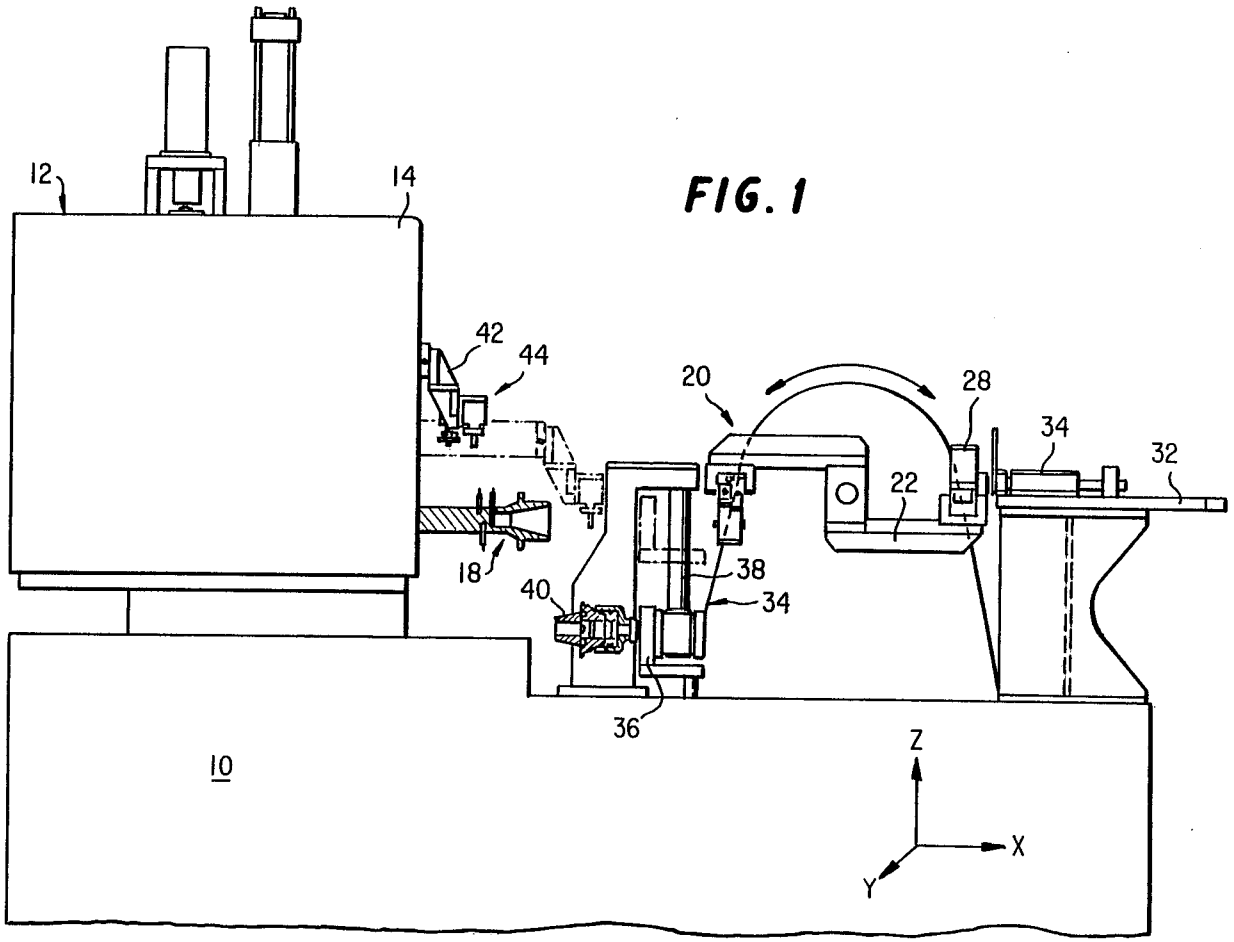
FIG. 1 is a side elevational view of a winding machine incorporating the present invention.
Figure 2:
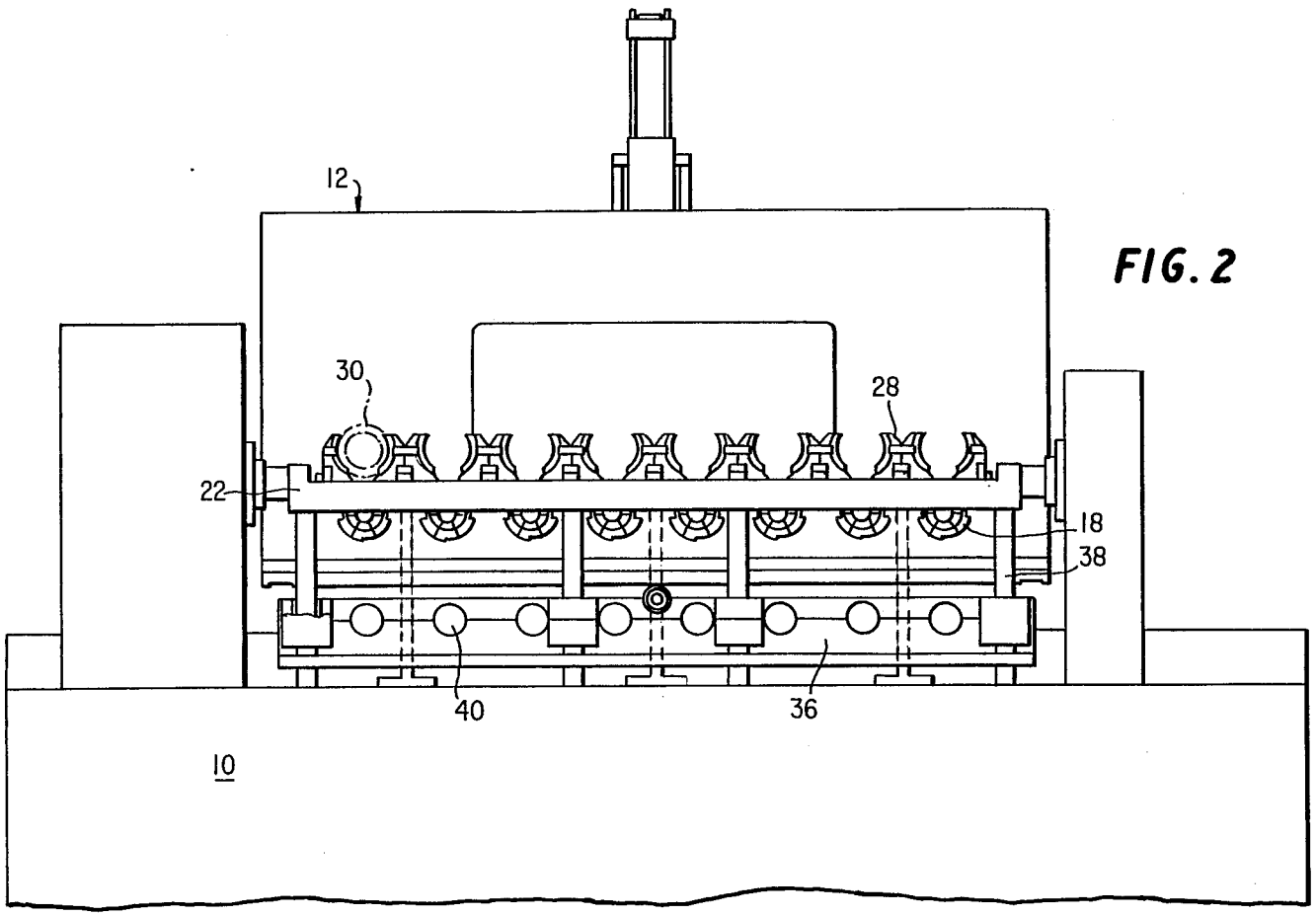
FIG. 2 is a front elevational view of the winding machine of FIG. 1.
Figure 3:
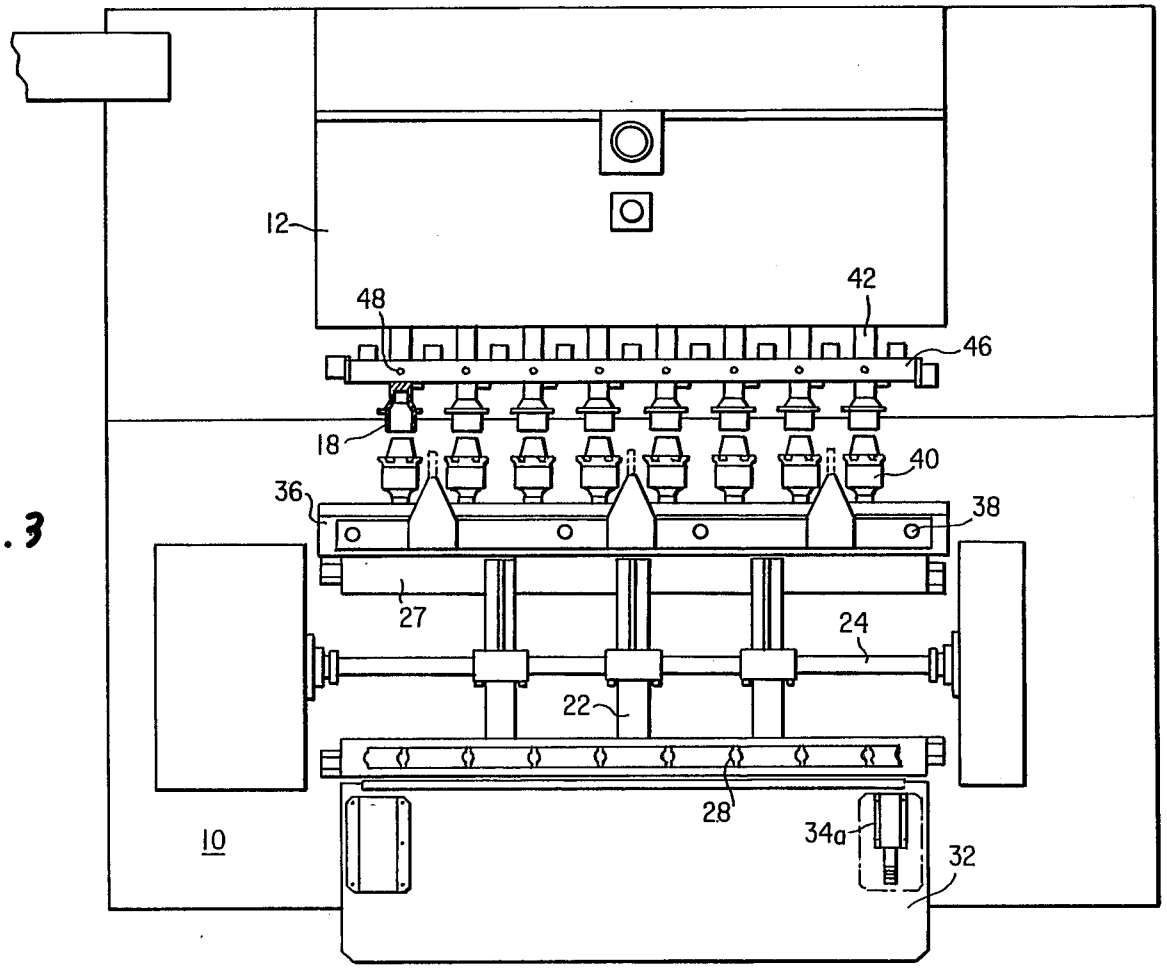
FIG. 3 is a plan view of the winding machine shown in FIG. 1.

FIGS. 1–3 show an embodiment of a wire winding machine adapted to the present invention. The machine shown in FIGS. 1–3 is an adaptation of a conventional wire winding machine such as that sold by Tekma-Kinomat SpA of Caronno Pertusella, Italy and manufactured by the EPM Corporation of Baltimore, Md. The machine is conventional, except as noted below.

A stationary base 10 supports a winder assembly 12. The winder assembly includes a housing 14 which is slidable along the X axis (see FIG. 1) on the base 10 by D.C. servomotors (not shown).

Figure 4A:
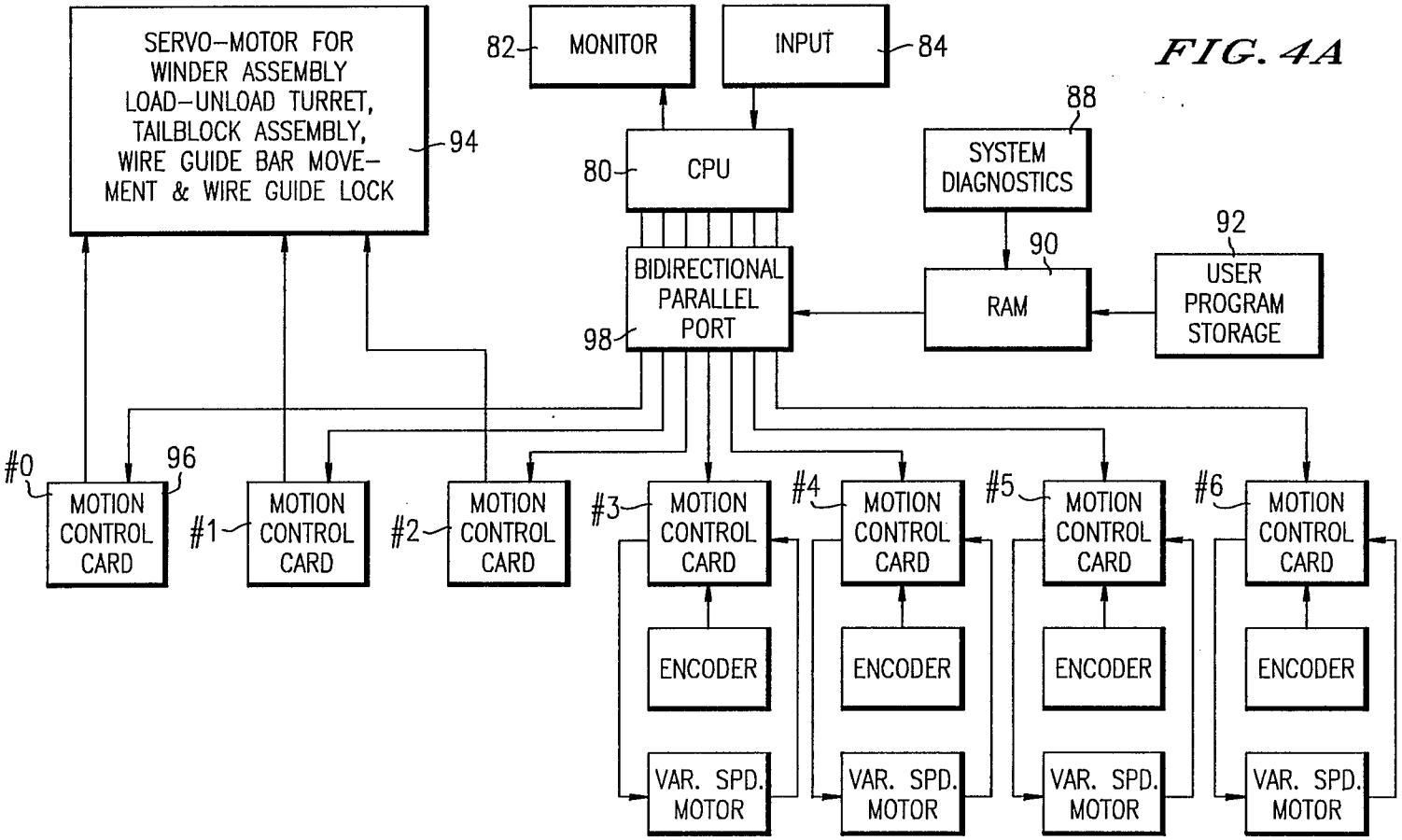
FIG. 4A is a schematic view of an embodiment of a control system according to the present invention.

The housing 14 also houses a row of 8 variable speed D.C. servomotors 16 (shown schematically in FIG. 4a) which are spaced in the Y direction. Each of these latter servomotors rotationally supports a spindle 18 which is mounted for rotation along the X axis and is described in greater detail below. Each of the spindles is capable of supporting a spool to be loaded or unloaded thereon by a load/unload turret 20.

The load/unload turret 20 comprises arms 22 mounted to a rotating shaft 24 which is indexed by 180° intervals by an air over oil rotary actuator. The arms support two load/unload bars 27, each of which carry a plurality of bobbin holders 28. Bobbins 30 supplied to the load table 32 are loaded into the bobbin holders by the loaders 349 in a known manner. Upon being so loaded, a 180° indexing rotation of the arms 22 presents the bobbins into alignment with the spindles 18. Subsequently, advancement of the spindles 18 in the X direction loads the bobbins onto the spindles in a known manner.

A tailstock assembly 34 comprises a tailstock bar 36 which is mounted to the vertical tailstock guides 38 and moved along the guides 38 by a pneumatic cylinder (not shown) which supports tailstocks 40. The tailstocks 40 are described in greater detail below and have piston heads which fit into the spindles 18 to axially and radially support the bobbins mounted thereon.

The traverse mechanism 44 includes wire guide bars 42 which are supported by known supports in the winder assembly housing 14 for movement in the X, Y and Z directions. One traverse mechanism 44 is shown in two positions in FIG. 1. The movement of the wire guide bar in the X, Y and Z directions is provided by D.C. servomotors (not shown) in the winder assembly housing 14.

Figure 12:
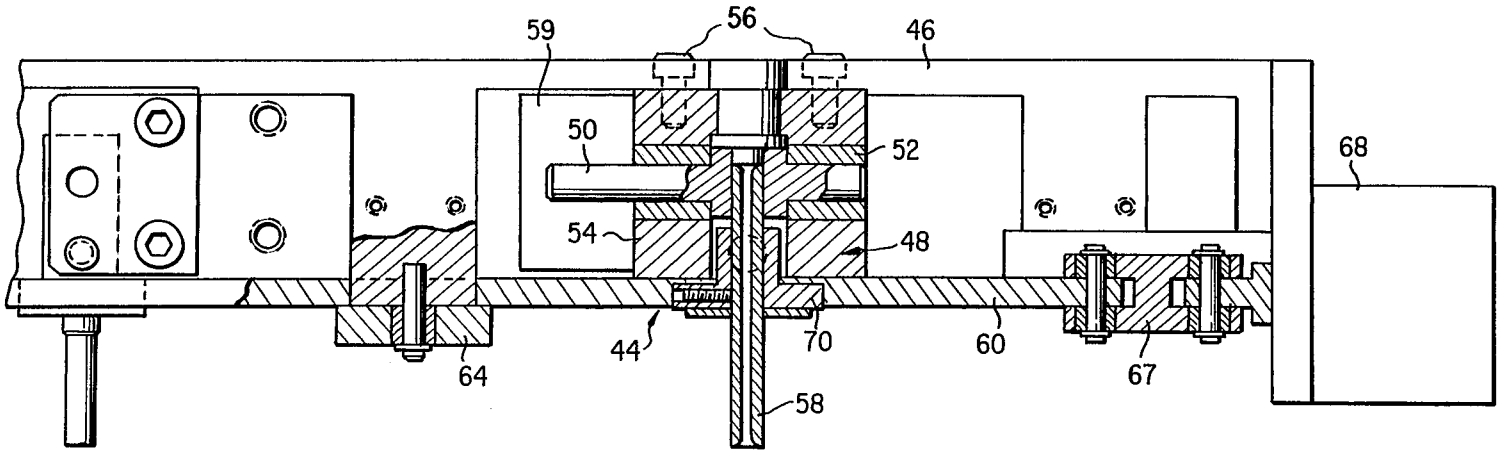
FIG. 12 is an elevational detail of the traverse.
Figure 13:
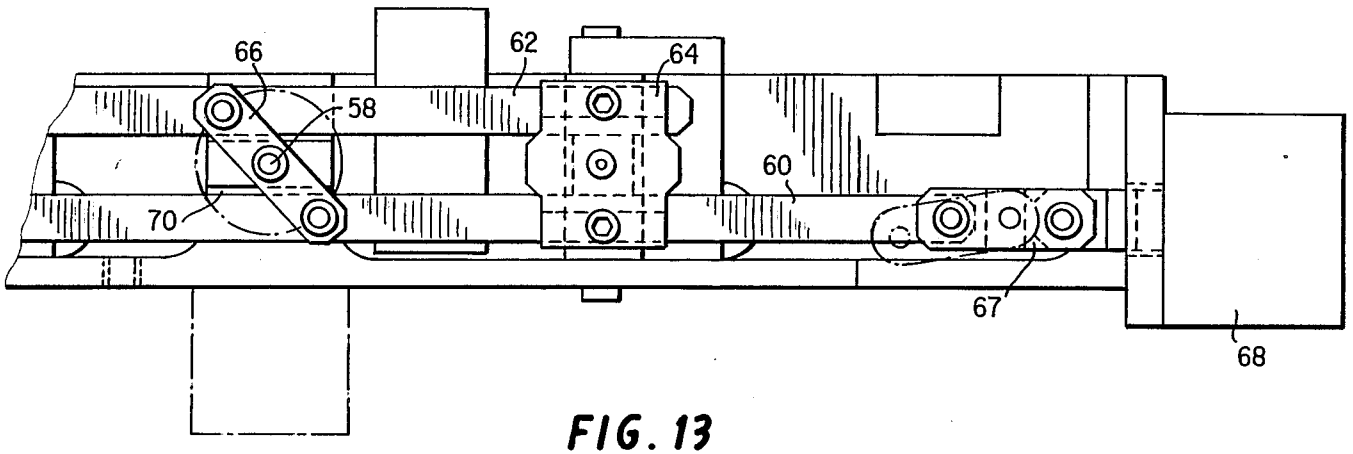
FIG. 13 is a bottom detail of the traverse.

The traverse mechanism 44 is shown in greater detail in FIGS. 12 and 13. FIG. 12 is a front elevational detail, partly in section, of the traverse 44. The traverse 44 comprises a L-suction traverse bar 46 which extends longitudinally in the Y direction and to which are mounted a plurality of wire guide assemblies 48 (one for each spindle). Each of the wire guide assemblies comprises a pivot 50 mounted for rotation in the Y axis, i.e. an axis substantially traverse to a plane containing the traversing path and a corresponding one of the spindle axes, on bushings 52 held in bearing supports 54 which are fixed to the traverse bar 46 by screws 56. A wire guide tube 58 is held in each of the pivots. The load angle (i.e., the deviation of the pivot angle from a plane containing the pivot axis and extending perpendicular to the spindle axis) of guide tube 58 is measured by a digital encoder 59.

All of the wire guide tubes 58 can be simultaneously locked against rotation and held fixed in a vertical orientation by a wire guide locking assembly. The wire guide locking assembly may comprise a pair of parallel elongate locking bars 60 and 62. The bars 60 and 62 are constrained by the brackets 64 fixed to the traverse bar 46 below the pivots. The brackets 64 permit the bars 60 and 62 to move longitudinally, as well as towards and away from one another, but not vertically. The bars 60 and 62 are pivotally connected to connecting pieces 66 which have apertures fitted around the wire guide tubes 58. One end of the bar 60 is connected to the air cylinder 68, via pivot link 67, and which is capable of moving the bar 60 along its length. Although not shown, another air cylinder is similarly provided for bar 62. Such movement of the bar 60 along its length causes rotation of the connecting pieces 66 and simultaneously causes the bars 60 and 62 to either separate from one another or approach one another. Upon retraction of the bar 60 by the servomotor 68 such that the bars 60 and 62 approach one another, flat sided extensions 70 of the pivots 50 are contacted by the bars 60 and 62 and locked with the guide tubes extending vertically, as shown in FIG. 13.

Although the above description refers to the use of bobbins 30, winding can also be provided without bobbins with coil turns being bonded together before unloading from the spindle.

Figures 4, 14:
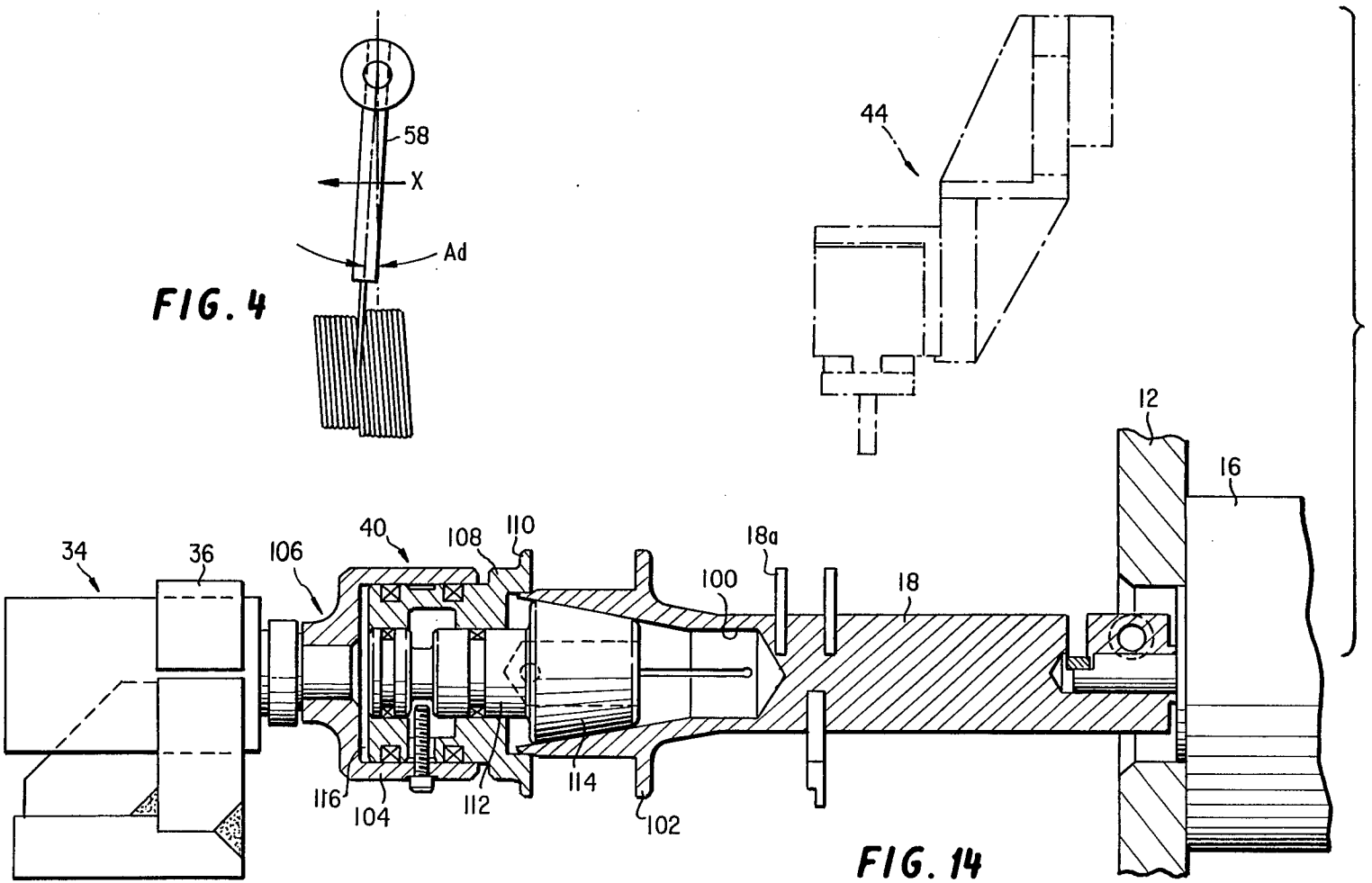
FIG. 4 schematically shows a detail of the winding operation.
FIG. 14 is an elevational view, partly in section, of a spindle and tailstock.

Referring to FIG. 4, in order to maintain the load angle Ad at the value best suited for the wire size and type to be wound, each encoder 59 reads a detected wire guide angle Ac, which is used to determine the instantaneous speed at which the corresponding spindle should rotate in order to achieve or maintain the desired angle Ad. Because of the fact that the parameters affecting perfect layer winding, which are basically the tolerance of the wire diameter and the tolerance of the width of the bobbin, vary slowly, it is not necessary to continuously monitor the load angle in order to maintain it. Instead, it is sufficient to periodically sample the value of Ac and to periodically correct the instantaneous speed $V_e$ of the spindle. In addition, in order to correct the instantaneous spindle speed it is sufficient to correct the distance it will travel during the sample time interval, for each sample taken.

For winding control (FIG. 4A), a computer, such as an IBM AT compatible, with an 80286 processor 80, interfaces with a monitor 82, operator input devices 84 including keyboard and/or touch-screen and RAM 90 which can receive stored user programs 92 and system diagnostic software 88. The CPU communicates with intelligent motion control cards 96 via a bidirectional parallel port 98. Each card 96 has its own CPU, RAM and EEROM and can control up to 2 servo motors based on a sequential program down loaded from the CPU 80 and stored the card RAM memory and on motion data received from the servo motors. Coordination between cards is achieved through hardware address line calls and handshake signals, managed by the sequential program, and specifically designed start-stop subroutines. In addition each motion control card can sense machine inputs and control machine outputs based on the user program sequence. Among other devices such outputs (motion control CARD 2) control the indexing of the load/unload turret 20 and the movement of the tailstock assembly 34 in the 2 direction. The controlled axes of motion are distributed as follows:

CARD 0 -wire guide bar 44 X axis +winding related outputs,

CARD 1 -wire guide bar 44 Y and Z axis,

CARD 2 -winder assembly 12 X axis +machine I/O,

CARD 3 through 6-8 spindle axes.

That is, spindle motion control cards 3 through 6 receive load angle data from 2 encoders 59 and in response controls 2 variable speed motors 16 in accordance with a speed profile stored in the user program therein.

Figure 5:
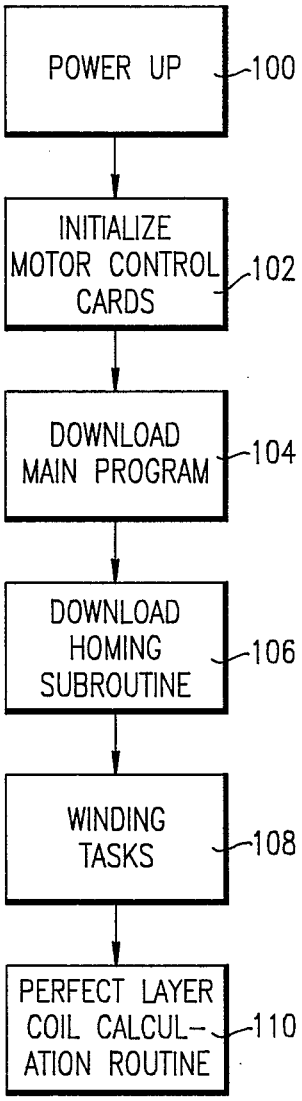
FIG. 5 is a block diagram illustrating a control system according to the present invention.

Referring to FIG. 5, upon powering up the control system at 100, the motion control cards are initialized at 102, by which an initialization file from the CPU 80 is down loaded to the motion control cards. This sets up the input/output registers, various auxiliary register definitions and the wire guide angle current and offset value registers.

The user main program is then down loaded at 104 to initialize the motion control card memories from the user program storage 92 via the CPU 80. The user program file contains the main program in which all machine operations executed during a machine cycle are contained, including load/unload of the bobbins to the winder, wire placing, termination, cutting and wire scrap removal, as well as the program for wire winding. Also, unloaded at this time is a homing subroutine (at 106) which is used to initialize the proper state of all outputs of the machine and calibrate the axes to their electromechanical reference. This routine also calibrates the wire guide angle registers by storing the necessary offset in the appropriate register. This assures that when the wire guides are locked in a vertical position the wire guide angle reads zero.

Figure 6:
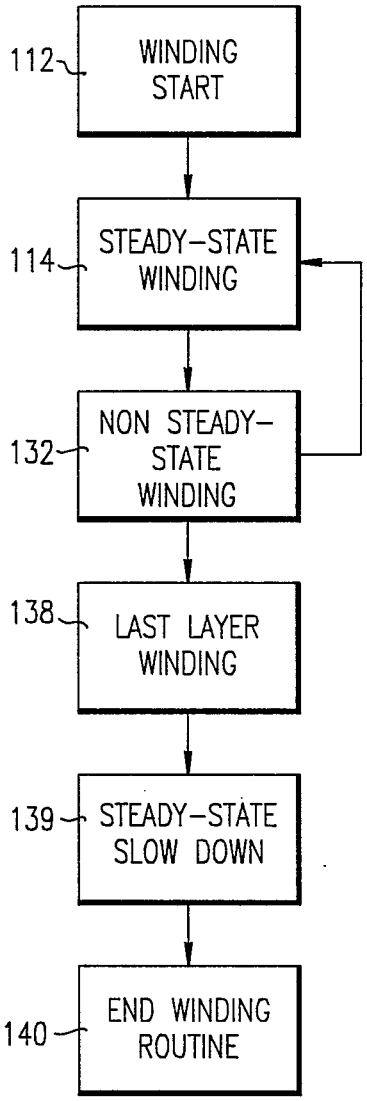
FIG. 6 shows in greater detail a portion of the control system of FIG. 5.

The perfect layer coil calculating routine 110 is generally shown in FIG. 6. It comprises essentially two primary modes of operation: steady state winding and non-steady state winding. Steady state winding is performed at all times except when the wound wire is adjacent one of the ends of a given layer. During steady state winding, the traverse speed is maintained constant and the rotational speed of each of the spindles 18 is independently adjusted to maintain the load angle at a predetermined value Ad.

The other primary mode of winding operation is non-steady state winding. This occurs when the wound wire approaches the ends of a layer to be wound (i.e., the ends of the bobbin). At this time, it is necessary for the wire to climb to the next layer and wind in the opposite direction. It is also necessary for the traverse movement to reverse while following the reversal of direction of the wire winding. Unlike steady state winding, in non-steady state winding the spindle speed remains constant while the traverse speed is varied.

Prior to the winding start operation, i.e., prior to step 112, the machine performs a series of tasks 108 that are common to all spindle winding machines: bobbins 30 are mounted on the spindles 18, the tailstock 40 is closed on the spindles in order to maintain their geometrical shape during winding (this is discussed in detail below); wire is wrapped around the start lead 18a terminal of the spindle, if present; the wire is placed in a start lead slot through which it gains access to the winding compartment of a spindle. In addition, the wire guide tubes are locked by the bars 60 and 62 of the locking mechanism, controlled by card 0.

Referring to FIG. 6, the winding start operation 112 is then performed prior to the beginning of steady state winding. The spindles are then rotated for the first few turns of winding while the wire guides are locked. These starting turns assure that there is no wire slack created during wire placing. The traverse axis is moved in the X direction to the point closest to the start end of a layer, i.e., closest to one flange of a bobbin, and is kept stationary during the winding start operation. In this way, an initial load angle Ac is generated while the first few turns are wound. Keeping the traverse stationary and the wire guides 58 locked during the first few turns also aids in preloading the winding and minimizing any possible loops that the start lead might create while entering the winding compartment of the bobbin.

The winding start operation also includes moving the wire guide bar in the Y direction to a point slightly spaced from the tangent of the bobbin, and towards the center of rotation of the spindle, so that the wire is slightly preloaded to one side of the wire guide 58 while taking up all the backlash between the wire guide and the wire. This affords a better tracking of the wire guide on the wire. Moreover, the traverse is moved in the Z direction (vertically) to a point where the wire guide tip will be as close as possible to the winding but still radially outside of the bobbin flanges.

At this point, the wire guides 58 are released by the locking mechanism and are free to tilt to a load angle. The wire guide encoders 59 will read an angle Ac for each of the wire guides which will be close to the desired load angle Ad. The machine is now stopped and ready to begin the steady state winding at 114.

In order to simplify programming, there is assumed the existence of a "nominal spindle" (see FIG. 9), which is the spindle running at the maximum required winding speed Vm, and for which the nominal wire would properly track the traverse axis. The nominal wire size and the traverse rate should be selected so that all of the wires to be actually wound are bigger than the nominal. In this way, the actual spindles will run at less than Vm, and the number of turns wound by them during perfect layer operation will never exceed the total number of turns desired.

Figure 9:
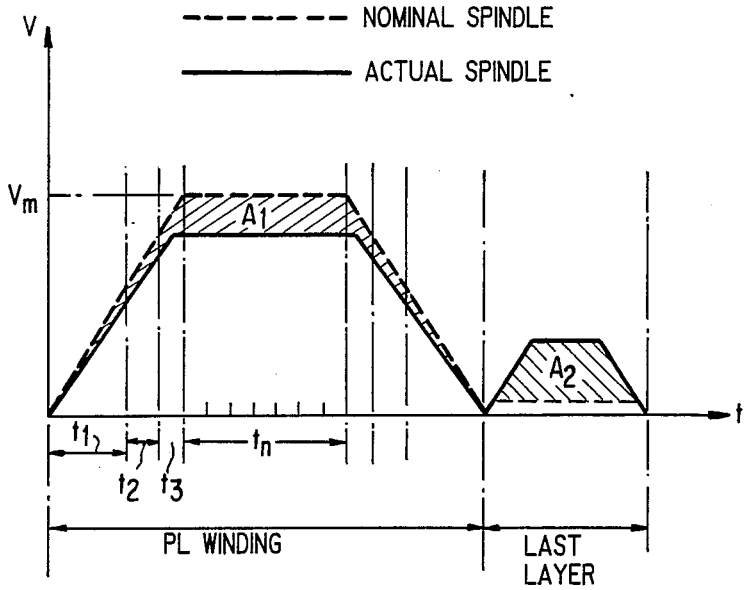
FIG. 9 is a graph of a winding operation according to the present invention.

Upon beginning steady state winding, the detected load angles Ac are sampled at sample intervals $t_n$ (FIG. 9). During start-up of steady state winding, the speeds Vs of the spindles are gradually increased by progressively decreasing the value of $t_n$, and at the end of a winding operation the spindle speeds are gradually decreased by progressively increasing the length of $t_n$. In this way, gradual acceleration and deceleration of the spindles is provided which avoids the possibility of a non-constant wire tension during acceleration and deceleration.

During steady state winding, in order to maintain the load angle at the value best suited for the wire size and type to be wound, the control system reads the detected wire guide angle Ac for each wire being wound and determines the distance by which the corresponding spindle should rotate during the next sample period in order to achieve or maintain the desired wire angle Ad. The spindle speed is then adjusted to provide this rotating distance. The sample periods should be sufficiently long that the motion control cards are able to perform all of the necessary calculations between sample periods. Once initial values are primed, the motion control cards calculate a desired spindle moving distance Dn during a sample period and ending velocity $V_e$ at the end of each sample period in accordance with equations 1 and 2 as follows:

$$Dn = \frac{Tn - (Ac - Ad) * Kt}{Tp + (Ac - Ap) * Kt} * Dp \quad (1)$$

$$Ve = \frac{Dn}{tn} - Vp \quad (2)$$

In the above equations:

Dn is the distance the spindle must move during the next sample period,

Dp is the distance the spindle has moved during the previous sample period,

Tn is the traverse motion during the next sample period,

Tp is the traverse motion during the previous sample period (Tn and Tp are constant when the nominal spindle turns per sample are constant), Ad is a desired load angle, Ac is a current load angle, Ap is a previous sample load angle, Kt is a correction constant for a system gain, tn is a preprogrammed sample time (sample period), Vp is a previous sample ending velocity.

The correction constant Kt depends on the distance of the pivot point of the wire guide from the tangent to the layer being wound and on the resolution of the wire guide encoder. All angles "A" are expressed in encoder counts. Kt is a transverse distance per unit of angular deflection of the wire guide. The Kt constant makes both the numerator and the denominator of equation 1 dimensionally correct; all terms are traverse distances. In addition, the Kt constant may also be called the "system gain", because by varying the value Kt it is possible to vary the amount of correction to the spindle speed that every sample will actuate. In fact, if Kt is set at zero, equation 1 does not provide any velocity correction for the spindle. Every time equation 1 is calculated and a new value of Dn is generated, the previous values are also updated to make them ready for the next calculation. Therefore, Tp becomes Tn, Ap becomes Ac and Dp becomes Dn.

Figure 7:
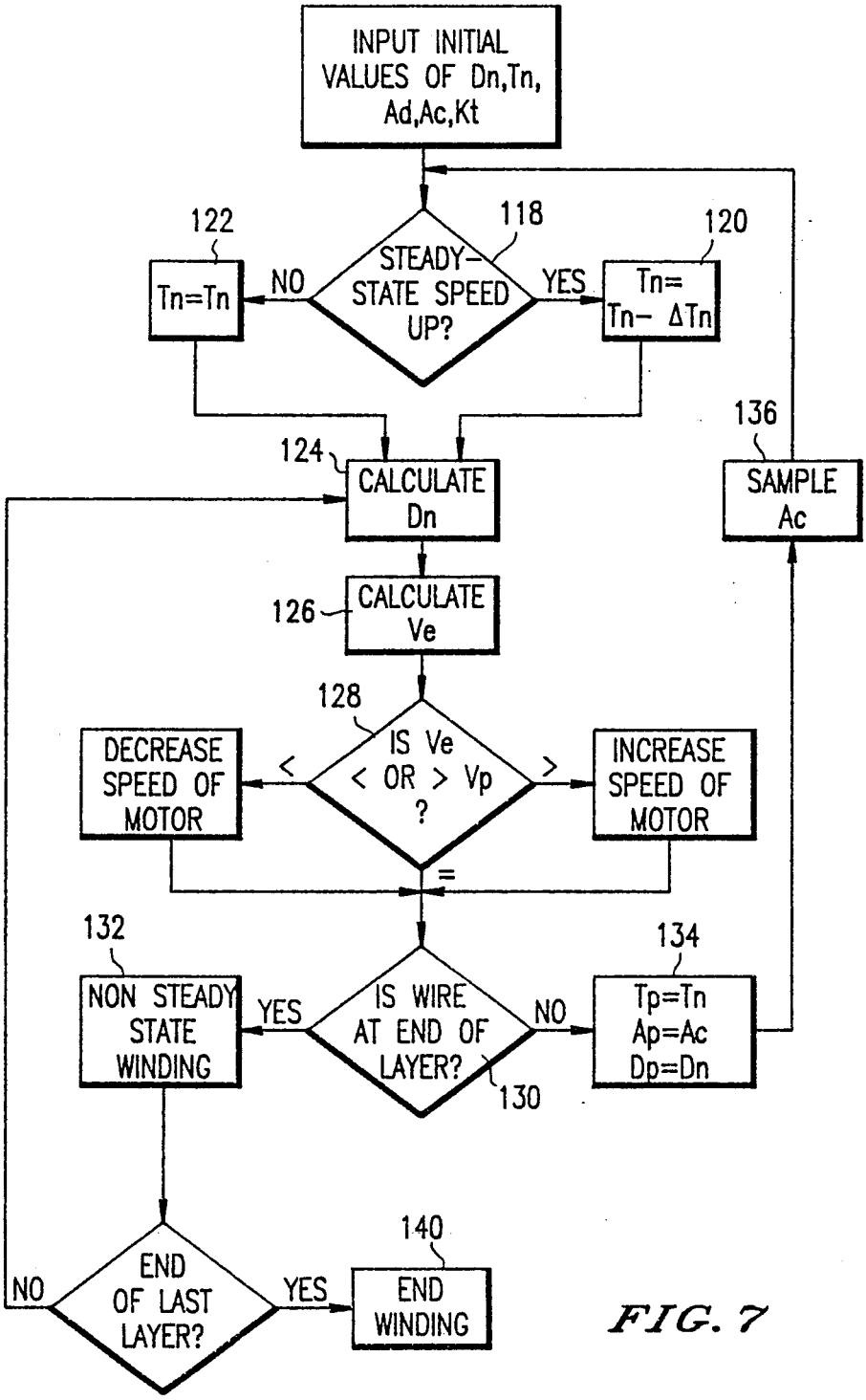
FIG. 7 shows in greater detail the steady state winding portion of the control system of FIG. 6.

Referring to FIG. 7, for steady state winding, initial values are input to the motor control cards at step 116. Steady state winding begins at step 118. If steady state speed-up is occurring, tn is decreased at step 120. If steady state winding is occurring at constant speed (after speed-up), tn is caused by the motor control cards to remain constant at step 122.

At step 124, Dn is calculated according to equation 1, after which Ve is calculated according to equation 2 at step 126. In step 128, it is tested whether Ve is less than, equal to, or greater than Vp. If less, the speed of the corresponding motor 16 is decreased. If greater, the speed of the corresponding motor 16 is increased. And if Ve equals Vp, the control passes directly to step 130.

At step 130, it is tested whether the wire will reach the end of a given layer in the next sample period. This is determined by the amount of time that has passed since wire winding for that layer has begun. If so, control passes to the nonsteady state winding routine at step 132. Otherwise, the values of Tp, Ap and Dp are reset at 134 and Ac is again sampled at step 136 to begin the next sampling period. Control is then returned to step 118.

If nonsteady state winding is called for, following the end of that nonsteady state winding, it is tested at 138 whether the last layer is being wound. If so, winding routine is initiated at step 140. Otherwise, control is returned to steady state winding at step 124.

When it is estimated from the winding time of a given layer that the wire will reach the end of the layer, i.e., the bobbin flange, prior to the completion of the next sample, control switches from steady state winding 114 to non-steady state winding at step 132. Unlike steady state winding, in non-steady winding the spindle velocity is maintained constant and the traverse motion Tn is changed. Three conditions must be sequentially met during non steady state winding. First, the load angle should be progressively reduced to zero at the time when the winding reaches the end of the layer, so that there will be no forces trying to pull the wire away from the bobbin flange when the wire jumps to the next layer. Second, the traverse direction must be changed. Third, the load angle must be permitted to reestablish itself during reverse winding of the next successive layer, prior to the reestablishment of steady state winding.

Figure 8:
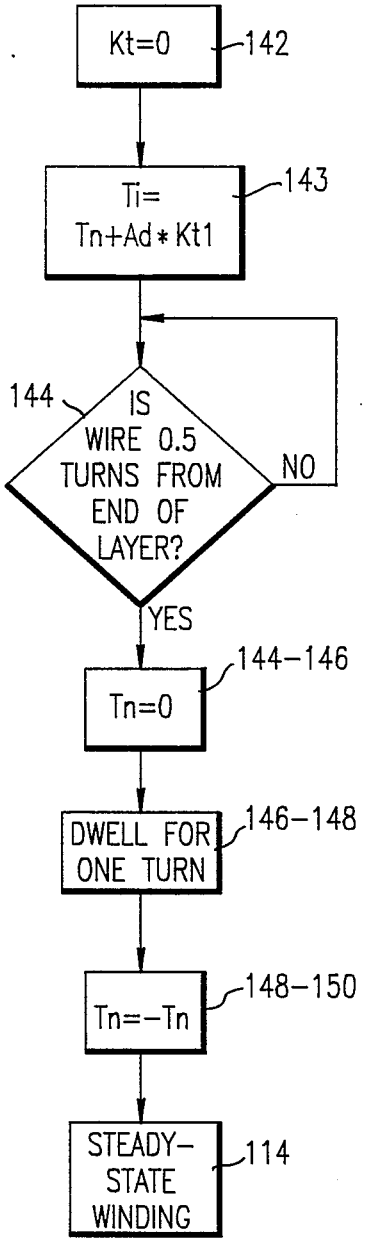
FIG. 8 shows in greater detail the non-steady state winding portion of the control system shown in FIG. 6.

Referring to FIG. 8, in step 142 the value of Kt is reduced to zero. As discussed earlier, this eliminates any variation in spindle speed resulting from variations in the detected load angle Ac. Instead, the traverse motion in this sample period should increase to a value Tl such that it "catches up" with the winding and so reduces the load angle to zero at the middle of the turn where the winding jumps from one layer to the next. The traverse motion Tl can be expressed as:

$$Tl = Tn + Ad * Ktl \quad (3)$$

where Ktl is the exact conversion constant of the load angle into linear traverse distance, in order for all of the spindles to reduce the load angle to zero. In order to assure that the spindle will not change speed at this time, the traverse distance fed to equation 1 will be only Tn, and not Tl.

Figure 10:
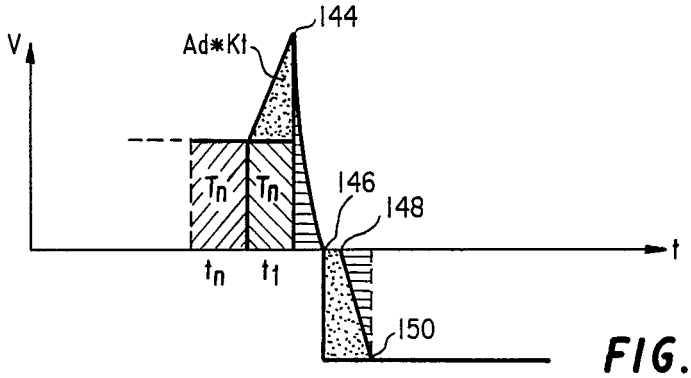
FIG. 10 is a graph illustrating the traverse speed during non-steady state winding.

Theoretically, the traverse motion should change from Tl to zero at the exact moment that the winding reaches the flange. However, in reality the inertia of the moving components makes this impossible. Instead, zero traverse motion is achieved (i.e., from point 144 to point 146 in FIG. 10) during two turns of the nominal spindle. The point 144 is reached at one-half turn of the nominal spindle before the winding reaches the end of the layer. The drop from points 144 to 146 occurs during the one-half turn prior to the winding reaching the end of the layer and the full turn during which the winding jumps to the next layer. Thus, at point 146 (FIG. 10) the winding is in the middle of the turn where it jumps from one layer to the next.

Before steady state winding of the subsequent layer can begin, however, it is again necessary to rebuild the load angle Ad, but with an opposite sign from the previous layer. This is achieved by providing a dwell period 146–148 equal to the time it would take for the nominal spindle to advance the wire a traverse distance Ad * Kt - 0.5 * Pn and then building up the traverse velocity along the slope 148–150, so that the traverse "shift" between the winding traverse position and the traverse axis position has the value Ad * Kt. After point 150, the load angle should be near the desired load angle Ad, and steady state operation can again begin at 114 (FIG. 8)

During the winding of this subsequent layer, the load angle will build up with a sign opposite to the one that it had in the previous layer. Therefore, equation 1 is again primed, but this time with values of opposite sign, so that the calculated spindle distance Dn will not change sign.

Since the diameter of the winding increases between one layer and the next, a Y axis movement of the traverse is provided during the dwell period 146–148 in order that the wire guide maintains roughly the same relationship to the tangent to the winding. This very short move is important in order to assure minimal lateral loading of the wire guide due to increasing coil diameter, and to maintain proper tracking of the wire guide to the winding. Theoretically, the amount of the move should be:

$$Y = \frac{\sqrt{3}}{2} * Wd \quad (4)$$

where:

Wd is the nominal wire diameter.

This value can be used as a first approximation, but might need to be increased due to the actual density of the perfect layer winding.

It should be noted that as successive layers are built up with alternating steady state and non-steady state winding, there occurs the sequence of (a) the build-up of the load angle, (b) steady state sampling, (c) reducing the load angle and (d) traverse reversal. The only difference between alternating (even and odd) layers is that the traverse is moved in opposite directions for alternate layers, and the load angle signs change so that the signs in equation 1 must be reversed. It is thus possible to program only one even and one odd layer, and then keep looping as many times as is necessary to wind the total number of turns.

Figure 11:
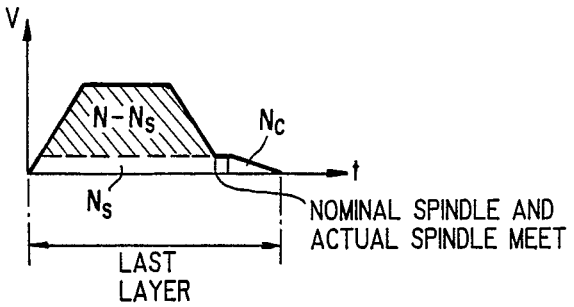
FIG. 11 is a graph showing the winding of the last layer.

Special considerations arise in winding the last layer. It is necessary not only to make up the difference A1 between the amount of wire wound by a nominal spindle and that wound by the actual spindle, but also to bring the end of the wire to the axial end of the bobbin (i.e., the exit flange). Therefore, as seen in FIGS. 9 and 11, the amount of wire wound in the last layer (step 138 of FIG. 6) is composed of two parts: a number of turns ($N-N_s$) which correspond to A2 (which is in turn equal to A1), and which compensates for the shortfall A1, and a number of turns Ns. These turns $N_s$ are wound with the load angle having been reduced to zero by accelerating the traverse (similar to a flange approach) and with all wire guides locked and no further load angle correction taking place. Spindles wind these turns $N_s$ at a pitch which causes the winding to reach the exit flange, at which time the nominal spindle and the typical spindle have wound the same number of turns. Finally, a number of turns Nc are close wound at the exit flange to finish winding, before placing the finish lead.

At the completion of winding, a series of tasks are performed, including finish lead routing, terminating, wire cutting and part unloading. All of these are performed using conventional motion control programming.

Although not illustrated, it may be possible to minimize the risk of turns dropping down to lower layers during winding by beginning with a tension higher than nominal, and decreasing the tension via an electronic tension device at every layer.

It may be appreciated that perfect winding requires a fixed diameter for the bobbin or spindle, and also fixed end limits for the layers, established, for example, by the bobbin flanges. However, the bobbin diameter is inwardly stressed by the winding tension and the bobbin flanges are laterally outwardly stressed by the winding tension. It is therefore necessary to reinforce the bobbin (or the coil wound directly on the spindle) in both the radial and axial directions.

Referring to FIG. 14, the tailstock assembly 34 provides structure capable of so reinforcing the spindle 18. The spindle 18 has a tapered end bore 100 and a first flange 102. The tailstock 40 includes a cup-like cylinder 104 which is mounted for rotation on a rotating pneumatic union 106.

Within the cylinder 104 is a first piston 108 having a second flange 110. A second piston 112 fits within the first piston 108 and has a head 114 which extends out from the first piston and is tapered with a shape to mate with that of the bore 100. A fluid pressure circuit (not shown) provides hydraulic fluid to the chamber 116 within the cylinder 104.

During operation, once a bobbin 30 has been placed on the end of the spindle 18 and the tailstock raised into alignment with the spindle, the winder assembly 12 moves in the X direction until the second flange 110 presses on the bobbin and the piston head 114 matingly fits within the tapered bore 100. Hydraulic pressure is then applied in chamber 116 which forcibly holds the second flange 110 and the piston head 114 in place, thereby radially and axially reinforcing the bobbin. Subsequent winding forces are therefore incapable of distorting the bobbin during winding.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system for simultaneously winding elongated filaments in at least one layer of turns on rotating spindles, comprising:

means for supporting a plural number of rotational spindles upon which spools may be mounted;

variable speed motors for separately driving each of said spindles;

a traverse movable along a traversing path substantially parallel to a axes of said spindles;

at least two filament guides mounted on said traverse for guiding filaments to be wound on said spindles;

means for separately detecting a position of each of said guides relative to said spindles along said traversing path; and control means responsive to said detecting means for independently controlling the rotational speed of each of said variable speed motors, whereby said filaments are wound in a desired pattern.

2. The system of claim 1, wherein said detecting means comprise:

a number of filament guide tubes corresponding to said plural number of spindles, each of said filament guide tubes being pivotally mounted to said traverse about a pivot axis substantially transverse to a plane containing said traversing path and a corresponding one of said spindle axes; and means for sensing an angle of deviation of a pivot angle of said filament guide tubes from a plane containing said pivot axis and extending perpendicular to said spindle axis.

3. The system of claim 2, wherein said sensing means comprises a digital encoder.

4. The system of claim 2, including means for simultaneously locking all of said wire guide tubes at positions wherein said angle of deviation is substantially zero.

5. The system of claim 2, wherein said control means comprise means for independently controlling the rotational speed of each of said variable speed motors such that said angle of deviation for each of said wire guide tubes substantially equals a desired load angle.

6. The system of claim 5, wherein said control means includes means for independently controlling the rotational speed of each of said motors in a plurality of sample periods so as to have a value Ve at the end of any sample period, wherein:

$$Ve = \frac{Dn}{tn} - Vp, \text{ where}$$

$$Dn = \frac{Tn - (Ac - Ad) * Kt}{Tp + (Ac - Ap) * Kt} * Dp, \text{ where:}$$

Ac is a sampled load angle at a sample point n,

Ad is a desired load angle,

Ap is a previously sampled load angle at sample point (n−1),

Dp is the angular distance the spindle has moved between sample points (n−1) and n, Dn is the angular distance the spindle is to move by sample point (n+1), Tp is the traverse distance between sample points (n−1) and n, Tn is the traverse distance between sample points n and (n+1), Vp is the rotational speed at the beginning of period n, tn is the sample period, and Kt is a correction constant or system gain, which is a function of a distance between said pivot axis and a tangent to the wound filament.

7. The system of claim 5, wherein said control means includes means for progressively reducing said angle of deviation substantially to zero when the filament being wound approaches and is adjacent an end of one of said layers of turns, and for progressively increasing said angle of deviation from substantially zero to a negative value of said load angle when said filament being wound departs from and is adjacent an end of one of said layers of turns.

8. The system of claim 6, wherein said control means includes means for progressively reducing said angle of deviation substantially to zero in a sample period when the filament being wound approaches and is adjacent an end of one of said layers of turns, and for progressively increasing said angle of deviation from substantially zero to a negative value of said load angle when said filament being wound departs from and is adjacent an end of one of said layers of turns.

9. The system of claim 8, wherein said means for progressively reducing said angle of deviation comprises increasing the traverse motion Tn of said traverse to a value Tl according to:

$$Tl = Tn + Ad * Ktl,$$

where Ktl is a conversion constant of the deviation angle into linear distance.

10. The system of claim 7, wherein said control means includes means for reversing the direction of movement of said traverse when said filament being wound reaches the end of one of said layers.

11. The system of claim 9, wherein said control means includes means for reversing the direction of movement of said traverse when said filament being wound reaches the end of one of said layers.

12. The system of claim 6, wherein said control means includes means for progressively varying the length of tn during starting and ending phases of a winding operation.

13. The system of claim 11, wherein said control means includes means for progressively varying the length of tn during starting and ending phases of a winding operation.

14. The system of claim 10, wherein said means for reversing includes means for laterally moving said guide tubes in a direction parallel to said pivot axis during reversing of the direction of movement of said traverse by an amount such that each said wire guide tube maintains a substantially constant relationship to a tangent to successive rows of wound filaments.

15. The system of claim 13, wherein said means for reversing includes means for laterally moving said guide tubes in a direction parallel to said pivot axis during reversing of the direction of movement of said traverse by an amount such that each said wire guide tube maintains a substantially constant relationship to a tangent to successive rows of wound filaments.

16. The system of claim 2 including means for selectively pivotally locking said guide tubes such that said angle of deviation is substantially zero.

17. A rotating spindle and tailstock assembly for winding a filament, comprising:

a spindle rotatable about a longitudinal axis thereof, said spindle having an axial bore extending from one end and tapering so as to have a progressively reduced diameter with increased distance from said one end;

a first supporting flange formed on said spindle adjacent said one end thereof;

a cylinder movable coaxially with said bore;

a first piston fitted in said cylinder and having a head extending from said cylinder and including a second support flange positionable at an end of said spindle by movement of said cylinder towards said spindle;

a second piston fitted in said first piston and having a head extending from said first piston, said head having a taper corresponding to the taper of said bore, said head matingly fitable in said bore by movement of said cylinder towards said spindle, fluid means in said cylinder for advancing said first and second pistons in a direction further towards said spindle;

whereby a filament being wound on said spindle between said first and second flanges is axially rigidly supported by said flanges and radially supported by said head of said second piston.

* * * * *